US005421559A

United States Patent [19]

Basler

[11] Patent Number: 5,421,559

[45] Date of Patent: Jun. 6, 1995

[54] DRIVE MECHANISM FOR A STOPPER IN A MOLTEN METAL VESSEL

[75] Inventor: Urs Basler, Arth, Switzerland

[73] Assignee: Stoping Aktiengesellschaft, Baar, Switzerland

[21] Appl. No.: 226,980

[22] Filed: Apr. 13, 1994

[30] Foreign Application Priority Data

Apr. 13, 1993 [CH] Switzerland ..... 01104/93

[51] Int. Cl.[6] ..... B22D 41/20

[52] U.S. Cl. ..... 266/78; 266/236; 222/602

[58] Field of Search ..... 266/236, 78; 222/597, 222/602

[56] References Cited

U.S. PATENT DOCUMENTS

| | | | |
|---|---|---|---|
| 2,832,110 | 4/1958 | Carleton, Jr. | 222/602 |
| 3,733,014 | 5/1973 | Pflaum | 222/602 |
| 5,312,090 | 5/1994 | Seaton et al. | 222/602 |

FOREIGN PATENT DOCUMENTS

| | | |
|---|---|---|
| 3135048A1 | 9/1981 | Germany . |
| 3731600A1 | 9/1987 | Germany . |

*Primary Examiner*—Scott Kastler
*Attorney, Agent, or Firm*—Wenderoth, Lind & Ponack

[57] ABSTRACT

A stopper drive mechanism is removably mounted on a molten metal vessel having a discharge opening and is adapted to move a stopper into and out of closing engagement with the discharge opening. A piston and cylinder unit of the stopper drive mechanism is operably connected with the stopper and has a valve unit connected thereto for controlling the piston and cylinder unit. The piston and cylinder unit comprises a cylinder that defines a working chamber with a piston slidably disposed therein. The piston has the same effective working area on opposite sides thereof. The valve unit comprises a control valve for controlling the flow of hydraulic fluid to and from the opposite sides of the piston and a bypass valve that is adapted to selectively communicate opposite sides of the piston with each other for manual movement of the stopper.

26 Claims, 2 Drawing Sheets

DRIVE MECHANISM FOR A STOPPER IN A MOLTEN METAL VESSEL

BACKGROUND OF THE INVENTION

1. Field of the Invention

The present invention relates to a drive mechanism for a closing element or stopper at the spout or discharge opening of a vessel containing molten metal.

2. State of the Prior Art

German Patent Document DE A1 31 35 048 discloses a known pouring level control for controlling the filling height of the metal melt in a continuous casting mold. In this document, a stopper is used as the closing element and is controlled by an operating cylinder. The stopper is controlled either through a servo valve connected to the operating cylinder or is moved manually by opening a bypass valve to connect opposite sides of the piston in the operating cylinder. The operating cylinder of this invention is designed as a differential cylinder, and the bypass valve and the servo valve can be rigidly connected as a subassembly to the operating cylinder.

Although the differential cylinder used in the above German patent document employs a simple method of construction, this fact is of minor importance when considered in the context of the operating environment. The distributing molten metal vessels that employ stoppers as closing elements do not have a problem with respect to the amount of space available for the provision of the operating cylinder.

However, the differential cylinder used in the above German Patent Document does have the drawback that the cross sectional areas of the cylinder chambers on the opposite sides of the piston in the cylinder vary in size. As a result, the control of the operating cylinder is complicated. Further, if the pressure lines are connected, as by the bypass valve, to connect the opposite sides of the piston for manual operation, either an excess or an insufficient amount of hydraulic fluid will flow from one side of the piston toward the other side of the piston. As a result, it is necessary that the hydraulic fluid either be returned to or drawn from the hydraulic fluid reservoir.

As noted above, the servo valve and the bypass valve can be rigidly connected together as one subassembly on the operating cylinder. However, this causes a weight increase of the operating cylinder. This weight increase is undesirable, because the operating cylinder frequently has to be removed from the molten metal vessel during operation.

SUMMARY OF THE INVENTION

In view of the above-noted problems with the known prior art drive mechanism for a stopper in a molten metal discharging vessel, it is a primary object of the present invention to provide a drive mechanism for a stopper in a molten metal vessel that facilitates optimum control and operation of the stopper. It is a further object of the present invention to facilitate manual operation of the stopper. It is another object of the present invention to provide a piston and cylinder unit of the drive mechanism that is as lightweight as possible.

The above objects of the present invention are achieved by the provision of an apparatus according to the present invention that includes a molten metal vessel that has a discharge opening, a stopper for opening and closing the discharge opening and a stopper drive mechanism that is adapted to move the stopper into and out of closing engagement with the discharge opening for controlling the discharge of molten metal from the molten metal vessel.

The stopper drive mechanism is detachably mounted on the molten metal vessel and comprises a piston and cylinder unit that is operably connected with the stopper. The stopper drive mechanism further comprises a valve unit that is adapted to control the piston and cylinder unit.

In a preferred feature according to the present invention, the piston and cylinder unit comprises a cylinder that defines a working chamber therein and a piston slidably disposed in the working chamber that has the same effective working area on opposite sides thereof. According to a further preferred feature according to the present invention, the valve unit comprises a control valve that is adapted to control the flow of hydraulic fluid to and from the opposite sides of the piston and a bypass valve that is adapted to selectively communicate the opposite sides of the piston with each other for manual movement of the stopper.

Preferably the cylinder comprises a first cylinder portion that has the working chamber therein and a second cylinder portion connected to the first cylinder portion. The second cylinder portion has the valve unit connected thereto. The piston is preferably designed so as to have a first piston rod connected to one side thereof and a second piston rod connected to the opposite side thereof, wherein the second piston rod extends into the second cylinder portion and the first piston rod is connected to one of the stopper and the molten metal vessel. The second cylinder portion advantageously has a stroke sensor adapted to detect the position of the second piston rod therein.

The first and second cylinder portions are preferably made of aluminum. The inside surface of the first cylinder portion, defining the working chamber, is subjected to a hardening surface treatment.

The control valve is preferably a four port, three position control valve that has two ports thereof communicating with the opposite sides of the piston and third and fourth ports communicating with a hydraulic fluid pressure source and a hydraulic fluid reservoir, respectively. In one embodiment, the bypass valve is advantageously connected with the control valve so as to represent a fourth position of the control valve. In another embodiment, the bypass valve is connected between hydraulic lines connecting the two ports to the opposite sides of the piston. Advantageously, a position sensor is adapted to provide a control valve position signal.

The second cylinder portion preferably has a rectangular outer shape. Hydraulic lines are preferably provided in the second cylinder portion, connecting the control valve with the working chamber. The valve unit is then mounted on the outer surface of the second cylinder portion.

It is further noted that the piston divides the working chamber into first and second subchambers on the opposite sides thereof. The piston is constructed so that movement of the piston in the working chamber causes a hydraulic fluid volume reduction in one subchamber equal to the hydraulic fluid volume increase in the other subchamber.

By providing the above-described arrangement according to the present invention, a first advantage is achieved in that it is not necessary, when opening the bypass valve and communicating the opposite sides of the piston with each other, to also provide a line communicating with the hydraulic fluid reservoir. Because the volumes of the subchambers are the same, i.e. because the effective working areas of the opposite sides of the piston are the same, the same volume of hydraulic fluid will flow from one subchamber toward the other subchamber upon movement of the piston. This allows for simple manual control without the need for a connection to the hydraulic fluid reservoir.

Making the two cylinder portions of the piston and cylinder unit out of aluminum provides a light piston and cylinder unit as a whole. Accordingly, the unit, which is frequently required to be removed, will not exceed the maximum allowable weight that can still be lifted by hand.

Further, the present invention provides a drive mechanism which overall is extremely compact and can be manipulated in a simple manner during everyday operations, making it possible for the level of the molten metal in the casting molds to be more accurately controlled.

BRIEF DESCRIPTION OF THE DRAWINGS

Further objects, features and advantages according to the present invention will become apparent to those of skill in the art from the following detailed description of preferred embodiments thereof, and with reference to the accompanying drawings, in which.

DETAILED DESCRIPTION OF THE PREFERRED EMBODIMENTS

Figure 1:
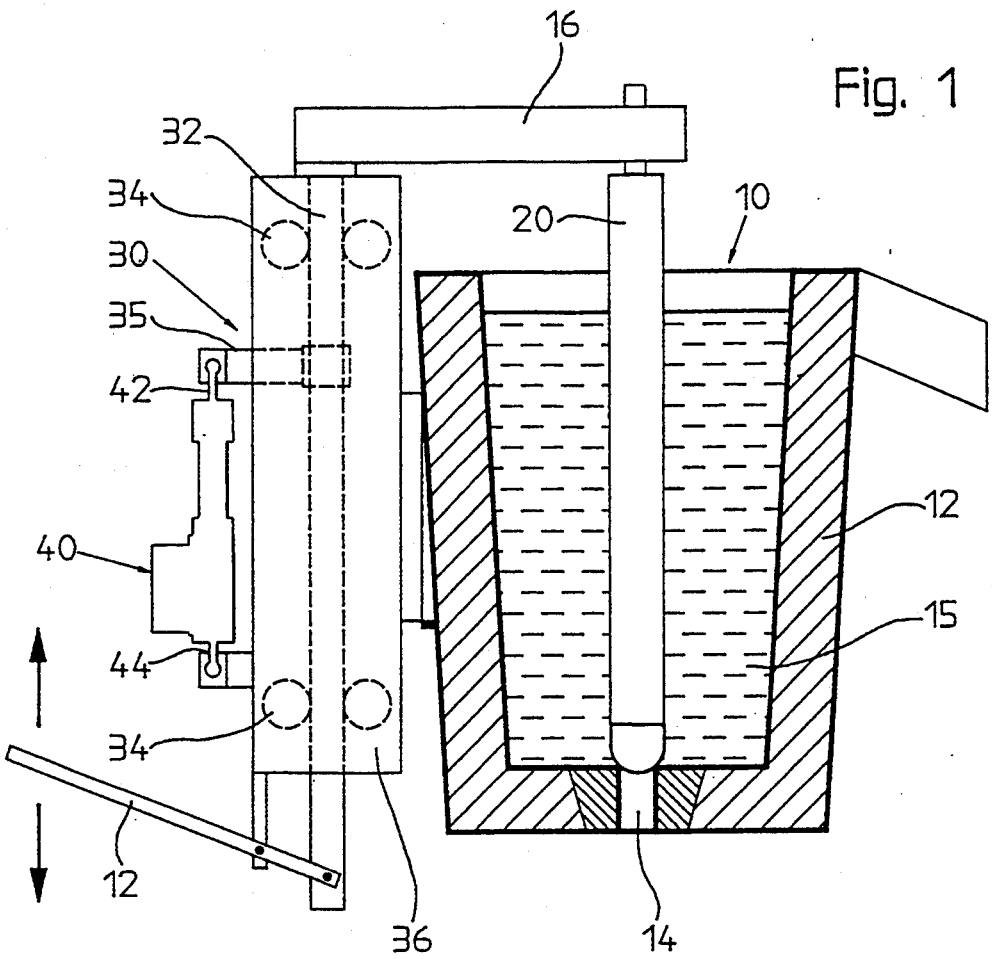
FIG. 1 is a schematic diagram, partly in cross-section, of a drive mechanism according to the present invention mounted for movement of a closing element in a molten metal vessel.

In FIG. 1 there is illustrated a molten metal vessel 10 having molten metal 15 therein, a discharge opening or spout 14 at the bottom thereof and a stopper 20 as a closing element closing the discharge opening 14. This type of arrangement is rather conventional in controlling the flow of molten metal from a molten metal vessel 10, such as a tundish. The molten metal 15 will flow from the discharge opening 14 into a continuous casting mold (not illustrated in the figure). A constant melt level must be maintained in the continuous casting mold. Such maintenance of the melt level is maintained in the continuous casting mold with the use of the stopper 20 to control the outflow of the molten metal from the vessel 10.

The stopper 20 is actuated by a drive mechanism 30 that is removably attached to the molten metal vessel 10. The drive mechanism 30 includes a linkage 16 connected to the stopper 20. The linkage 16 can be moved up and down either manually, by a if lever 12, or automatically through the use of a motor unit 40. A lifting rod 32 connects the linkage 16 to both the lever 12 and a connecting element 35 connecting the lifting rod 32 to the motor unit 40. The lifting rod 32 moves up and down on bearings 34 provided in a housing 36 of the drive mechanism 30. The connecting element 35 connects to the motor unit 40 through a piston rod 42 as illustrated in the figure. A coupling element 44 connects the other end of the motor unit 40 to the housing 36 of the drive mechanism 30.

Figure 2:
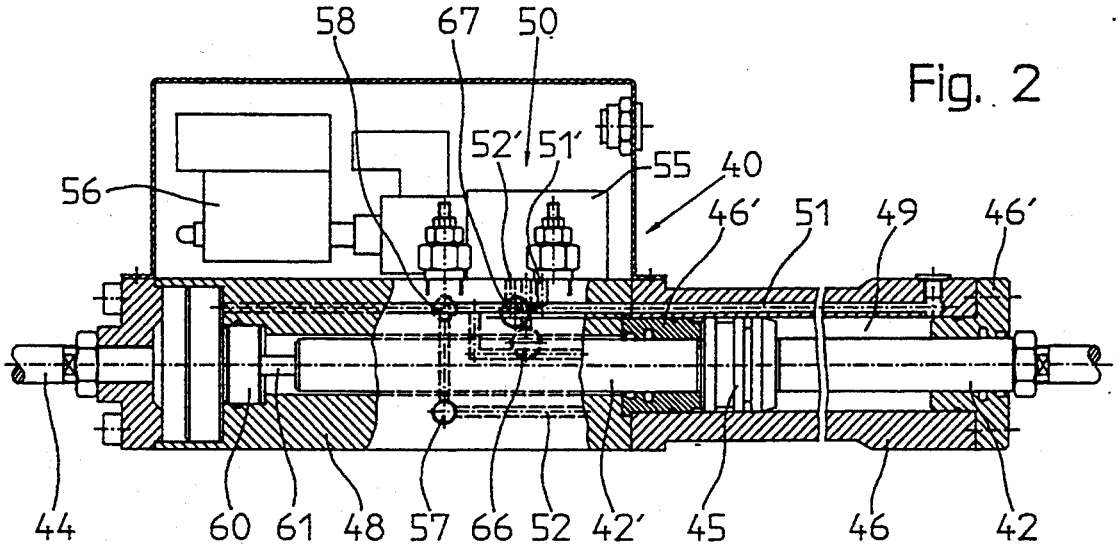
FIG. 2 is an elevational view, partly in cross-section, of a piston and cylinder unit having an integrated valve unit according to the present invention.

FIG. 2 illustrates the motor unit 40 in cross section. A piston 45 is guided in a cylinder working chamber 49, and has the piston rod 42 connected to one side thereof and a piston rod 42' connected to the other side thereof. The cylinder comprises a first cylinder portion 46, defining the working chamber 49 therein having the piston 45 therein, and a second cylinder portion 48. The second cylinder portion 48 extends from the first cylinder portion 46 and receives the piston rod 42'. The second cylinder portion 48 has a valve unit 50 thereon and also contains a sensor 60 coaxial with the piston rod 42'.

According to a preferred feature of the present invention, the motor unit 40 is provided with the piston and cylinder unit so that, for a given hydraulic fluid pressure, the same force would result from that fluid pressure whether it was applied on one side of the piston 45 or on the other side. In other words, the piston 45 has the piston rods 42 and 42' provided with the same diameters. Thus the piston presents the same effective working area on both sides thereof, and the working chamber 49 will experience the same amount of volume change on both sides of the piston 45 when the piston is slid therein.

A guide bushing 46' is provided in one end of the first cylinder portion 46, and receives the piston rod 42'. Beyond this bushing 46', the piston rod 42' extends into the second cylinder portion 48. According to a further preferred feature of the present invention, both the cylinder portion 46 and the cylinder portion 48, detachably connected to each other, are made of aluminum. The inside surface of the cylinder portion 46 that makes contact with the piston 45 is preferably hardened in a known manner so that the cylinder will not wear prematurely.

The cylinder portion 48 has two hydraulic lines 51 and 52 extending therethrough. These hydraulic lines communicate with and extend into the cylinder portion 46, and communicate with the working chamber 49 on respective opposite sides of the piston 45. The hydraulic lines 51 and 52 are integrated with the cylinder portion 48, and extend to the valve unit 50.

The stroke length sensor 60 is provided to detect the stroke length of the piston rod 42', i.e. to provide an indication of the position of the piston rod 42' so that the location of the piston 45, and thus the stopper 20, is known and can be appropriately controlled. The stroke length sensor 60 is also provided in the cylinder portion 48. The stroke length sensor 60 comprises a measuring piston 61 which projects into the piston rod 42', which is provided with a suitable bore therein, and determines in a known manner, through the evaluation of an electronic signal, the position of the piston rod 42', and thus the position of the piston 45 in the working chamber 49.

According to a further feature according to the present invention, the cylinder portion 48 is advantageously designed to be square or rectangular in configuration. As a result, valves can be attached with an appropriate seal to the resulting flat surfaces of the cylinder portion 48 without having to design any special bearing surfaces.

The hydraulic lines 51 and 52 that extend from the cylinder portion 46 into the cylinder portion 48 have openings or outlets 51' and 52', respectively The valve unit 50 comprises a control valve 55, and the outlets 51' and 52' communicate with the control valve 55. It can be further seen from FIG. 2 that the control valve 55 is housed in a protective hood on the surface of the cylinder portion 48. The control valve 55 is used to control the piston 45 through the hydraulic lines 51 and 52.

A displacement sensor 56 is provided adjacent to the control valve 55, and indicates at any time the position of the valve. Channels 57 and 58 can also be seen in FIG. 2. These channels extend perpendicularly to the plane of the figure from the hydraulic lines 51 and 52, respectively, and are also provided in the cylinder portion 48, being integrated therewith. The channels 57 and 58 lead to respective pressure relief valves, by means of which the pressure in the working chamber on opposite sides of the piston 45 can be suitably limited. The second portion 48 also has channels 66 and 67 that are connected to the lines 51 and 52, respectively, and which are guided by the control valve 55 into a hydraulic fluid pressure generating unit or into a hydraulic fluid reservoir (not shown).

Because the second cylinder portion 48 is made of aluminum, or possibly a similar lightweight material, and the hydraulic lines and the valve unit 50 are integrated with the second cylinder portion 48, significant advantages result over known arrangements. These advantages are that the motor unit 40 is very lightweight, very compact and thus very small in its dimensions. The second cylinder portion 48 also forms a component of the piston and cylinder unit having the equal effective working areas on opposite sides of the piston, and thus provides a number of functions in a single component.

Figure 3:
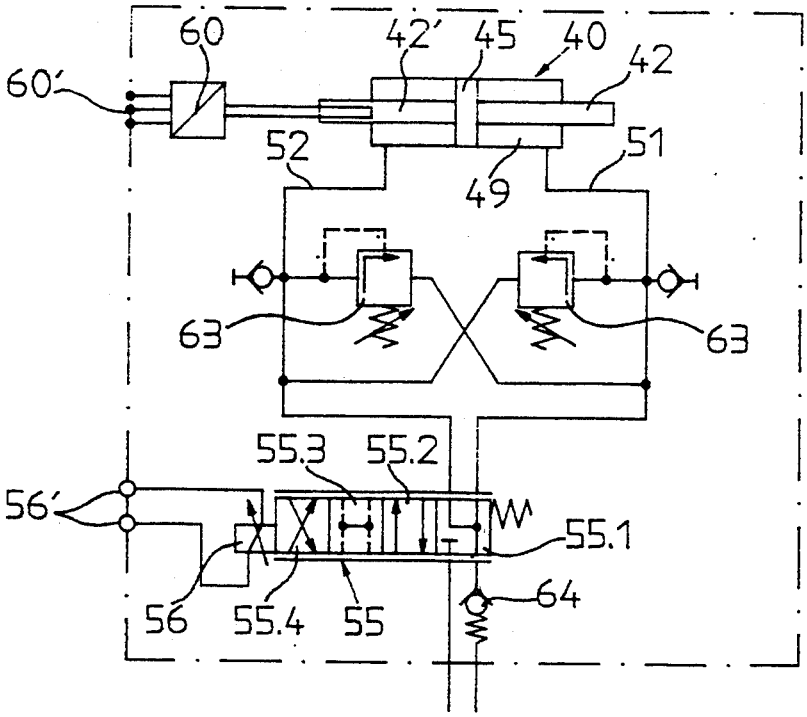
FIG. 3 is a schematic diagram of a first embodiment of a hydraulic circuit according to the present invention.

FIG. 3 is a hydraulic schematic diagram according to a first embodiment of the motor unit 40 of the present invention. As can be seen from this schematic diagram, the control valve 55 is a four port, three position (way) valve that is provided with an additional position beyond the first three positions. This position is illustrated in the figure, and represents a bypass position connecting subchambers of the working chamber 49 to each other. Four positions 55.1–55.4 are thus illustrated for the control valve 55, the position 55.1 communicating the bypass valve portion of the control valve with the working chamber 49.

The sensor 56 of the control valve 55 is illustrated in FIG. 3, and provides a position feedback signal 56' indicating the position of the control valve 55. An internal position control loop for the control valve 55 is thus achieved, which will be discussed in more detail with respect to FIG. 5.

The control valve 55 is connected with two ports on one side thereof, one port being connected to a pressure vessel for hydraulic fluid under pressure, and the other port being connected to a collecting tank or reservoir through a non-return valve 64.

The non-return valve 64 is illustrated in FIG. 3 as connected with the bypass valve section of the control valve 55 in the position 55.1. In this position, the hydraulic fluid cannot flow back toward the reservoir except when a certain minimum pressure is exceeded, for example one bar. Thus, manual control of the stopper 20 can proceed with hydraulic fluid flowing back and forth between the subchambers on either side of the piston 45 in the working chamber 49 without fluid flowing back to the reservoir. However, should some over pressure condition occur resulting in it being necessary for fluid to flow back to the reservoir, this is also possible.

As illustrated, the control valve 55 communicates through two hydraulic lines 51 and 52 with the working chamber 49. Two valves 63 are provided connecting the hydraulic lines 51 and 52 to each other. These valves are provided for pressure peak or over pressure conditions. That is, when the stopper 20 has to be closed rapidly, in order to prevent damage to the stopper from a too-rapid closing of the stopper, one of the hydraulic lines 51 and 52 will be connected to the other hydraulic line through a valve 63 upon the occurrence of a certain maximum pressure, which pressure could also be adjusted and set. In this way, the force that acts on the stopper can be temporarily reduced.

If the control valve 55 is moved into either position 55.2 or 55.4, the piston 45 will be moved to the right or to the left by the application of hydraulic fluid pressure. In position 55.3, the piston will remain in position.

Figure 4:
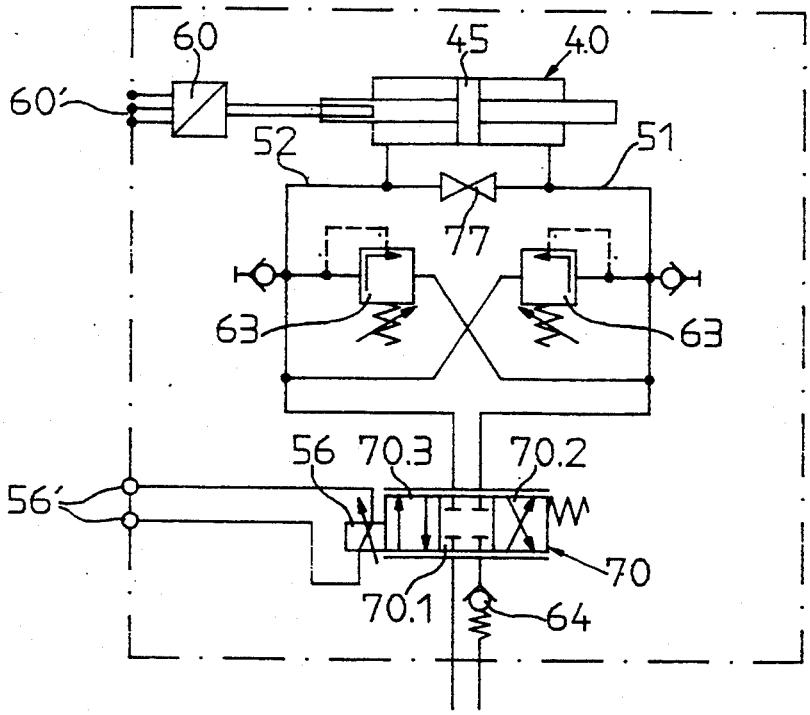
FIG. 4 is a schematic diagram of a second embodiment of a hydraulic circuit according to the present invention.

FIG. 4 illustrates an alternative embodiment of the hydraulic fluid control system of FIG. 3. In this embodiment, the control valve is designated by reference number 70. Only those features that differ from the embodiment of FIG. 3 will be explained. This valve is also a four port, three way valve having three positions 70.1, 70.2 and 70.3. There is no position which connects the two hydraulic lines 51 and 52 as in the embodiment of FIG. 3. Instead, there is provided a separate shut off valve 77 that directly connects the lines 51 and 52. With this valve, the hydraulic lines 51 and 52 can be manually connected to each other and controlled for manual displacement of the piston 45.

Figure 5:
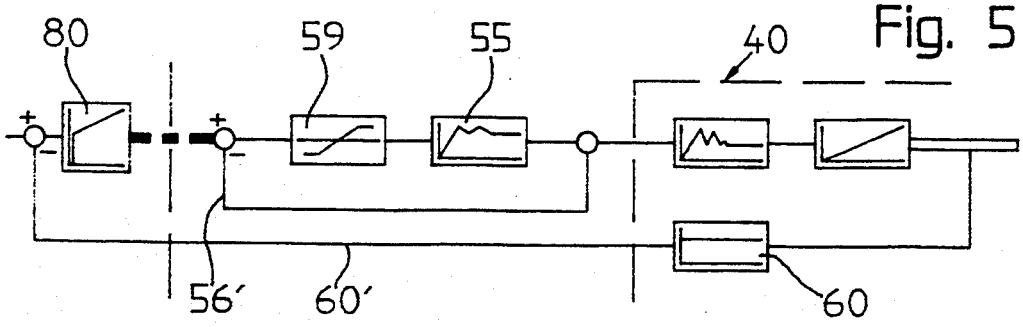
FIG. 5 is a schematic illustration of an automatic control operation of the closing element in the molten metal vessel according to the present invention.

FIG. 5 is a simple flow diagram illustrating the control of the stopper 20 in accordance with the present invention. A controller 80 is schematically illustrated. A control signal is sent from the controller 80 to an amplifier 59 and then to the control valve 55 for positioning the control valve. The sensor 56 provides a subsequent position feedback signal 56' indicating the position of the control valve 55. Accordingly, by the employment of the feedback signal 56', the control valve 55 will always be situated in the desired position. The control valve 55 then proceeds to control the piston and cylinder unit. The position of the piston 45 is indicated by the stoke length sensor 60. A feedback signal 60' is thus sent back to the controller 80, which can continue control of the control valve 55 based upon the position of the piston 45. Accordingly, the level of molten metal in a casting mold can be maintained to an accuracy of a few millimeters.

In the above-described embodiments, a stopper 20, as is illustrated in FIG. 1, was disclosed as the closing element. However, the present invention can be applied to many different types of closing elements known in the art, for example as illustrated in German Patent Publication DE 37 31 600 A1. Other modifications and variations of the present invention will be apparent to those of skill in the art, and should be considered within the scope of the present invention as set forth in the appended claims.

I claim:

1. An apparatus, comprising:

a molten metal vessel having a discharge opening;

a closing element for opening and closing said discharge opening; and a closing element drive mechanism adapted to move said closing element into and out of a closing position with respect to said discharge opening for controlling the discharge of molten metal from said molten metal vessel, said closing element drive mechanism being detachably mounted on said molten metal vessel and operably connected with said closing element, and said closing element drive mechanism comprising a piston and cylinder unit and a valve unit adapted to control said piston and cylinder unit;

wherein said piston and cylinder unit comprises a cylinder defining a working chamber therein and a piston slidably disposed in said working chamber having the same surface area on opposite sides thereof exposed to said working chamber of said cylinder; and wherein said valve unit comprises a control valve adapted to control the flow of hydraulic fluid to and from the opposite sides of said piston and a bypass valve adapted to selectively communicate the opposite sides of said piston with each other for manual movement of said stopper.

2. The apparatus of claim 1, wherein said cylinder comprises a first cylinder portion having said working chamber therein and a second cylinder portion connected to said first cylinder portion, said second cylinder portion having said valve unit connected thereto.

3. An apparatus, comprising:

a molten metal vessel having a discharge opening;

a closing element for opening and closing said discharge opening; and a closing element drive mechanism adapted to move said closing element into and out of a closing position with respect to said discharge opening for controlling the discharge of molten metal from said molten metal vessel, said closing element drive mechanism being detachably mounted on said molten metal vessel and operably connected with said closing element, and said closing element drive mechanism comprising a piston and cylinder unit and a valve unit adapted to control said piston and cylinder unit;

wherein said piston and cylinder unit comprises a cylinder defining a working chamber therein and a piston slidably disposed in said working chamber having the same effective working area on opposite sides thereof;

wherein said valve unit comprises a control valve adapted to control the flow of hydraulic fluid to and from the opposite sides of said piston and a bypass valve adapted to selectively communicate the opposite sides of said piston with each other for manual movement of said stopper;

wherein said cylinder comprises a first cylinder portion having said working chamber therein and a second cylinder portion connected to said first cylinder portion, said second cylinder portion having said valve unit connected thereto; and wherein said piston has a first piston rod connected to one side thereof and a second piston rod connected to the opposite side thereof, wherein said second piston rod extends into said second cylinder portion and said first piston rod is removably connected to one of said stopper and said molten metal vessel.

4. The apparatus of claim 3, wherein said second cylinder portion has a stroke sensor adapted to detect the position of said second piston rod therein.

5. An apparatus, comprising:

a molten metal vessel having a discharge opening;

a closing element for opening and closing said discharge opening; and a closing element drive mechanism adapted to move said closing element into and out of a closing position with respect to said discharge opening for controlling the discharge of molten metal from said molten metal vessel, said closing element drive mechanism being detachably mounted on said molten metal vessel and operably connected with said closing element, and said closing element drive mechanism comprising a piston and cylinder unit and a valve unit adapted to control said piston and cylinder unit;

wherein said piston and cylinder unit comprises a cylinder defining a working chamber therein and a piston slidably disposed in said working chamber having the same effective working area on opposite sides thereof;

wherein said valve unit comprises a control valve adapted to control the flow of hydraulic fluid to and from the opposite sides of said piston and a bypass valve adapted to selectively communicate the opposite sides of said piston with each other for manual movement of said stopper;

wherein said cylinder comprises a first cylinder portion having said working chamber therein and a second cylinder portion connected to said first cylinder portion, said second cylinder portion having said valve unit connected thereto; and wherein said first and second cylinder portions are made of aluminum, and wherein an inside surface of said first cylinder portion, defining said working chamber, has been subjected to surface hardening treatment.

6. The apparatus of claim 2, wherein said second cylinder portion has a rectangular outer shape and comprises hydraulic lines connecting said control valve with said working chamber.

7. The apparatus of claim 6, wherein said valve unit is mounted on a flat outer surface of said second cylinder portion.

8. The apparatus of claim 1, wherein said control valve is a four port, three position control valve having two ports thereof communicating with the opposite sides of said piston and third and fourth ports communicating with a hydraulic fluid pressure source and a hydraulic fluid reservoir, respectively, and wherein said bypass valve is connected with said control valve so as to represent a fourth position of said control valve.

9. The apparatus of claim 8, wherein said control valve further comprises a position sensor adapted to provide a control valve position signal.

10. The apparatus of claim 1, wherein said control valve is a four port, three position control valve having two ports thereof communicating with the opposite sides of said piston and third and fourth ports communicating with a hydraulic fluid pressure source and a hydraulic fluid reservoir, respectively, and a position sensor adapted to provide a control valve position signal.

11. The apparatus of claim 1, wherein said piston divides said working chamber into first and second subchambers on the opposite sides thereof and is constructed such that movement of said piston in said working chamber causes a hydraulic fluid volume reduction in one said subchamber equal to the hydraulic fluid volume increase in the other said subchamber.

12. The apparatus of claim 1, wherein said control valve is a four port, three position control valve having two ports thereof communicating with the opposite sides of said piston and third and fourth ports communicating with a hydraulic fluid pressure source and a hydraulic fluid reservoir, respectively, and wherein hydraulic lines connect said two ports with said working chamber on the opposite sides of said piston.

13. The apparatus of claim 12, wherein said hydraulic lines are connected to each other by said bypass valve.

14. A drive mechanism for moving a closing element into and out of a closing position with respect to a discharge opening of a molten metal vessel for controlling the discharge of molten metal from the molten metal vessel, said drive mechanism comprising:

a piston and cylinder unit adapted to be detachably mounted on the molten metal vessel and operably connected with the closing element; and a valve unit adapted to control said piston and cylinder unit;

wherein said piston and cylinder unit comprises a cylinder defining a working chamber therein and a piston slidably disposed in said working chamber having the same surface area on opposite sides thereof exposed to said working chamber of said cylinder; and wherein said valve unit comprises a control valve adapted to control the flow of hydraulic fluid to and from the opposite sides of said piston and a bypass valve adapted to selectively communicate the opposite sides of said piston with each other.

15. The drive mechanism of claim 14, wherein said cylinder comprises a first cylinder portion having said working chamber therein and a second cylinder portion connected to said first cylinder portion, said second cylinder portion having said valve unit connected thereto.

16. A drive mechanism for moving a closing element into and out of a closing position with respect to a discharge opening of a molten metal vessel for controlling the discharge of molten metal from the molten metal vessel, said drive mechanism comprising:

a piston and cylinder unit adapted to be detachably mounted on the molten metal vessel and operably connected with the closing element; and a valve unit adapted to control said piston and cylinder unit;

wherein said piston and cylinder unit comprises a cylinder defining a working chamber therein and a piston slidably disposed in said working chamber having the same effective working area on opposite sides thereof;

wherein said valve unit comprises a control valve adapted to control the flow of hydraulic fluid to and from the opposite sides of said piston and a bypass valve adapted to selectively communicate the opposite sides of said piston with each other;

wherein said cylinder comprises a first cylinder portion having said working chamber therein and a second cylinder portion connected to said first cylinder portion, said second cylinder portion having said valve unit connected thereto; and wherein said piston has a first piston rod connected to one side thereof and a second piston rod connected to the opposite side thereof, said second piston rod extending into said second cylinder portion.

17. The drive mechanism of claim 16, wherein said second cylinder portion has a stroke sensor adapted to detect the position of said second piston rod therein.

18. A drive mechanism for moving a closing element into and out of a closing position with respect to a discharge opening of a molten metal vessel for controlling the discharge of molten metal from the molten metal vessel, said drive mechanism comprising:

a piston and cylinder unit adapted to be detachably mounted on the molten metal vessel and operably connected with the closing element; and a valve unit adapted to control said piston and cylinder unit;

wherein said piston and cylinder unit comprises a cylinder defining a working chamber therein and a piston slidably disposed in said working chamber having the same effective working area on opposite sides thereof;

wherein said valve unit comprises a control valve adapted to control the flow of hydraulic fluid to and from the opposite sides of said piston and a bypass valve adapted to selectively communicate the opposite sides of said piston with each other;

wherein said cylinder comprises a first cylinder portion having said working chamber therein and a second cylinder portion connected to said first cylinder portion, said second cylinder portion having said valve unit connected thereto; and wherein said first and second cylinder portions are made of aluminum, and wherein an inside surface of said first cylinder portion, defining said working chamber, has been subjected to a surface hardening treatment.

19. The drive mechanism of claim 15, wherein said second cylinder portion has a rectangular outer shape and comprises hydraulic lines connecting said control valve with said working chamber.

20. The drive mechanism of claim 19, wherein said valve unit is mounted on a flat outer surface of said second cylinder portion.

21. The drive mechanism of claim 14, wherein said control valve is a four port, three position control valve having two ports thereof communicating with the opposite sides of said piston and third and fourth ports communicating with a hydraulic fluid pressure source and a hydraulic fluid reservoir, respectively, and wherein said bypass valve is connected with said control valve so as to represent a fourth position of said control valve.

22. The drive mechanism of claim 21, wherein said control valve further comprises a position sensor adapted to provide a control valve position signal.

23. The drive mechanism of claim 14, wherein said control valve is a four port, three position control valve having two ports thereof communicating with the opposite sides of said piston and third and fourth ports communicating with a hydraulic fluid pressure source and a hydraulic fluid reservoir, respectively, and a position sensor adapted to provide a control valve position signal.

24. The drive mechanism of claim 14, wherein said piston divides said working chamber into first and second subchambers on the opposite sides thereof and is constructed such that movement of said piston in said working chamber causes a hydraulic fluid volume reduction in one said subchamber equal to the hydraulic fluid volume increase in the other said subchamber.

25. The drive mechanism of claim 14, wherein said control valve is a four port, three position control valve having two ports thereof communicating with the opposite sides of said piston and third and fourth ports communicating with a hydraulic fluid pressure source and a hydraulic fluid reservoir, respectively, and wherein hydraulic lines connect said two ports with said working chamber on the opposite sides of said piston.

26. The drive mechanism of claim 25, wherein said hydraulic lines are connected to each other by said bypass valve.

* * * * *